US005819446A

United States Patent [19]

Pearl et al.

[11] Patent Number: 5,819,446

[45] Date of Patent: Oct. 13, 1998

[54] SLEEVER PAD WITH RESIDUE AND HEAT AND MOISTURE REPELLANT FEATURES

[75] Inventors: Leo Pearl, Lincolnwood; Bill G. Walthall, Hoffman Estate; Hector Hernandez, Chicago, all of Ill.

[73] Assignee: Resillo Press Pad Company, Lincolnwood, Ill.

[21] Appl. No.: 848,575

[22] Filed: Apr. 28, 1997

[51] Int. Cl.[6] ..... D06F 71/28

[52] U.S. Cl. ..... 38/66; 223/73

[58] Field of Search ..... 38/66, 20, 21, 38/140; 223/66, 68, 70, 72, 73

[56] References Cited

U.S. PATENT DOCUMENTS

| | | | |
|---|---|---|---|
| 2,490,981 | 12/1949 | Reiss et al. | 238/66 |
| 2,729,370 | 1/1956 | Maxwell et al. | 223/73 |
| 2,743,853 | 5/1956 | McLagan | 38/66 X |
| 3,321,852 | 5/1967 | Anderson et al. | 38/66 |
| 3,603,011 | 9/1971 | Cohen | 38/140 X |
| 4,507,179 | 3/1985 | Everett | 223/73 |

OTHER PUBLICATIONS

"Cabinet Bag Sleever CBS/CBX–C" brochure, Ajax, Cincinnati, Ohio, 2 pages, 1993.

"3 More Ways to Get the Most Out of your Flatwork Ironers" brochure, Resillo Press Pad Company, Chicago, Illinois, 1 page (date unknown).

*Primary Examiner*—Ismael Izaguirre

*Attorney, Agent, or Firm*—Greer, Burns & Crain, Ltd.

[57] ABSTRACT

A sleever pad for use with a sleeve pressing device of the type that includes a buck upon which the sleever pad is designed to be mounted, a fabric bag adapted to be placed over the sleever pad, and a set of heating plates that are arranged to press a sleeve of a garment placed over the bag. Included on the present sleever pad are a relatively stiff internal core and a covering that surrounds the internal core. The covering includes an outer covering layer which faces outwardly toward the sleeve being pressed and an inner liner which faces inwardly toward the buck. A main feature of the outer covering layer is that it is configured for preventing moisture and/or solvents present on the sleeve of the garment being pressed from migrating through the outer covering layer to the internal core. In addition, the outer covering layer is also configured for inhibiting heat from being transferred from the heating plates through said sleever pad to the buck during a pressing operation.

20 Claims, 1 Drawing Sheet

SLEEVER PAD WITH RESIDUE AND HEAT AND MOISTURE REPELLANT FEATURES

BACKGROUND OF THE INVENTION

The present invention generally relates to an improved sleever pad for use with a sleeve pressing device that is intended to press the sleeves of a shirt, or other type of garment, after the garment has been laundered. More particularly, the present invention relates to a sleever pad that prevents the moisture and/or the cleaning solvents that are retained on the garment after laundering from migrating through and collecting on the sleever pad. In addition, the improved sleever pad of the present invention also inhibits heat from the heating plates of the pressing device from being transferred through the sleever pad, and instead reflects the heat back towards the heating plates. Further, in the sleever pad of the present invention, the moisture resistant and the heat reflecting features are not substantially diminished with the repeated use of the sleever pad during the pressing of multiple garments.

There is currently available an apparatus for facilitating the pressing of garment sleeves in which each of the two sleeves of the garment is placed on a padded sleeve supporting structure of the apparatus. This sleeve supporting structure is commonly referred to as a "buck." After each of the sleeves is positioned on a corresponding padded buck, the buck and sleeve combinations are then moved within the enclosure of the pressing apparatus, where a pair of opposed heating plates come together to press each sleeve.

There are several types of pads currently available for the buck. These pads will be referred to as "sleever pads." One of the better pads currently available is made with a wire mesh core. The core is surrounded by two different types of fabric, where one type of fabric is a liner used for the portion that faces the buck, and the other type of fabric is used for the portion that faces the sleeve of the garment. The fabric used for the liner portion facing the buck is typically polyester. The other fabric, the fabric for the portion that faces the sleeve, is typically a material called Nomex®, which is a registered trademark of E. I. duPont de Nemours & Company of Wilmington, Del., and is a synthetic fiber of the nylon family of materials.

One of the problems with the currently available sleever pads is that, over time, they retain the fluids, detergents and/or solvents used during the laundering process. In order to save time, garments are often placed in the sleeve pressing device before being properly dried. Accordingly, the garment contains a solution of an excessive amount of water and any number of the following solvents: detergent; starch; "sour," which is a compound used for cutting grease; bleach; and possibly other solvents known to those of ordinary skill in the art. This solution of water and assorted solvents is generally passed from the garment to the sleever pad. While conventional Nomex® pads initially repel water, over time, the sleever pad can absorb a substantial amount of moisture and different solvents, which each tend to come out of solution as the water evaporates from the sleever pad. These concentrated solvents can then form a residue known as "grease," which tends to migrate to the lower portions of the sleever pad.

When the sleever pad is heated during the pressing process, the assorted solvents may be transferred back to the garment being pressed. The garment may then be stained by the solvents, which are now out of solution, and thus are in a more concentrated form. Once stained, the garment needs to be laundered again, which wastes both time and money.

In addition to requiring re-laundering, the concentrated solvents may also damage the garment in a more lasting manner. For example, starch is known to be corrosive to fabric. While the corrosive effects of regular strength starch are normally considered as being minimal, the corrosive effects of the concentrated starch are magnified when compared to the effects of regular strength starch, and will noticeably reduce the life of the garment.

A further problem created by the lack of moisture resistance is that the moisture and solvents are permitted to enter the internal core of the sleever pad. This internal core is conventionally made from layers of a metallic mesh material. After the moisture and solvents migrate into the internal core, the metallic mesh material my become corroded and deteriorate, which reduces the structural rigidity of the pad.

In addition to the loss of structural rigidity, the deterioration of the internal core also enables the pad to be flattened with repeated use. Once the pad is flattened, the metal plates cannot properly compress against the pad and garment sleeve, which hinders the sleeve from being properly pressed. This occurs, in part, because the heating plates are configured to be operated with a buck and buck pad of a certain thickness. If that thickness is reduced beyond a certain level, the heating plates will not contact the garment sleeve with the adequate degree of force to sufficiently press the sleeve. Once the pad is flattened beyond a certain point, either the pad needs to be replaced, or the heating plates need to be adjusted (if possible), both of these solutions take time and cost money.

To compensate for this reduction in thickness, the press operators often cover the padded buck with a layer (or layers) of cotton flannel. While this may help the problem of the reduced thickness of the padded buck, it exacerbates the problems associated with the moisture and solvent retention on the padded buck. The cotton flannel material is even more absorbent than the Nomex® material conventionally used. Accordingly, even more solvents are retained on the cotton flannel than would be on the Nomex® material. Because more concentrated solvents are retained on the cotton flannel, there is an even higher occurrence of staining the freshly laundered sleeves with these solvents.

An additional problem with a sleever pad that retains moisture is the time required to dry the garment. When a wet garment is placed against a wet sleever pad, more time is required to dry the garment than if the wet garment were placed against a dry pad. This problem is also magnified if layers of moisture-absorbent flannel are placed over the sleever pad. Accordingly, if the drying time could be reduced, more garments could be pressed in a shorter time, which increases the revenue of the laundering operation.

When a sleever pad with the conventionally used Nomex® exterior is new, it does have some minimal level of moisture resistant properties, which are desirable because they eliminate, or at least minimize, the problems associated with moisture and solvents being transferred back to the garment, as discussed above. However, after a relatively short period of repeated use of considerably less than the expected life of one year or more, the moisture resistant properties of the Nomex® material diminish to a point where they are essentially non-existent. As the pad absorbs more moisture, the problems discussed above manifest themselves.

An additional drawback of the conventional sleever pads is that they permit the heat from the heating plates to be transferred, in an essentially unrestricted manner, through the sleever pad to the buck, which is normally made of some form of metal. This occurs because the metal buck acts as a heat sink, which draws heat from the heating plates. Such a configuration is not the most efficient use of the heat from the heating plates, and results in the use of more than the necessary amount of time and energy to dry and press the garments because part of that heat is diverted, and wasted, by heating up the metal buck.

Accordingly, one object of the present invention is to provide an improved sleever pad for use with a sleeve pressing device.

An additional object of the present invention is to supply an improved sleever pad that, over its working life of at least one year or more, does not retain the moisture and solvents utilized during the cleaning process.

Another object of the present invention is to furnish an improved sleever pad with a moisture resistant covering so that concentrated solvents do not build up on the sleever pad, which may result in the garment being stained if the concentrated solvents are transferred back to the garment. This improved sleever pad should reduce the amount of staining, which in turn reduces the amount of relaundering required, and therefore will help to decrease operating expenses.

A further object of the present invention is to provide an improved sleever pad that includes a moisture resistant covering whose moisture resistant properties endure throughout repeated use of the pad during its working life of at least one year or more.

A still further object of the present invention is to supply an improved sleever pad that includes a heat reflective material that inhibits heat from being transferred through the sleever pad to the buck during the pressing process.

Yet another object of the invention is to provide an improved sleever pad with a heat reflective material that improves the efficiency of the sleeve pressing device through a more efficient use of the heat from the heating plates, and enables damp garments to be dried more quickly than with the conventional sleever pad.

These and other objects of the present invention are discussed or will be apparent from the following detailed description of the invention.

SUMMARY OF THE INVENTION

The above-listed objects are met or exceeded by the present sleever pad, which is designed for use with a sleeve pressing device of the type that includes a buck upon which said sleever pad is configured to be mounted, a fabric bag adapted to be placed over said sleever pad, and a set of heating plates that are arranged to press a sleeve of a garment placed over the bag. However, it is contemplated that the sleever pad of the present invention may also be modified to be used with other types of sleeve pressing devices, or that the present invention may even be modified for use with devices for pressing portions of garments other than sleeves. Although, in the interest of conserving space, the present invention will only be described with respect to the use of the improved sleever pad in conjunction with one type of sleeve pressing device.

More particularly, the sleever pad of the present invention includes a relatively stiff internal core and a covering that surrounds the internal core. The covering includes an outer covering layer which faces outwardly toward the sleeve being pressed and where the outer covering layer is made of a moisture resistant material for preventing either moisture or solvents, or both, which are present on the sleeve of the garment being pressed from migrating through the outer covering layer to the internal core. The moisture resistant material is also configured for inhibiting the collection of either moisture or solvents, or both, on the sleever pad. Further, the effectiveness of the outer covering layer of the present invention is not substantially diminished with repeated use of the sleever pad.

The moisture resistant outer covering layer of the present sleever pad is beneficial for a number of reasons. First, a sleever pad that is resistant to moisture and solvents will not allow the moisture and solvents from the freshly laundered garment to build up upon it. Instead, the moisture and solvents (which will remain in solution, and not in a concentrated form) will be retained with the garment. In this manner, the solvents will not come out of solution and adhere to the sleever pad, where they may migrate to different levels of concentrated solvents, which could cause stains by being be transferred back to the laundered garment in this concentrated state. Accordingly, with a moisture resistant sleever pad, the amount of re-laundering of garments because of stains caused by concentrated solvents will be reduced, if not entirely eliminated.

Additionally, the moisture resistant feature of the present invention also prevents moisture and solvents from reaching the wire mesh internal core of the sleever pad. If the internal core is protected from such corrosive elements, it will not become corroded and deteriorate. A reduction in the level of corrosion and deterioration permits the sleever pad to maintain its original rigidity and level of thickness, which are both necessary for the sleever pad to operate with maximum effectiveness. Once these features diminish beyond a certain point, the useful life of the sleever pad is over. However, because the moisture resistant material helps to preserve the original rigidity and thickness of the sleever pad, the useful life of the sleever pad may be extended by the use of such a moisture resistant material on the outer surface thereof.

A third benefit of the moisture resistant material is that it helps to reduce the time required to dry a damp garment. The moisture resistant material helps to reduce the drying time by not permitting the moisture to be transferred from the freshly laundered garment to the sleever pad. Since the moisture on the garment remains with the garment, it is in closer proximity to the heating plates. Thus, the moisture can be quickly evaporated by the heat from the heating plates. Therefore, with quicker moisture evaporation, a reduction in drying time is achieved.

As an additional aspect of the present invention, the moisture resistant outer covering layer of the sleever pad is also made of a heat reflective material that inhibits heat from being transferred from the heating plates through the sleever pad to the buck, during a pressing operation. The use of a heat reflective material for the sleever pad enables the heating plates to be used more efficiently because the heat generated by the plates will be reflected back towards the plates, instead of being lost to the metal buck which would otherwise act as a heat sink. Thus, in essence the heat from the heating plates will pass through the garment being pressed twice—a first time as it is travels from the heating plates to the sleever pad, and then a second time as it is reflected back toward the heating plates from the sleever pad. In this manner, the time required for properly drying and pressing a garment is reduced, when compared to a conventional device that does not include the sleever pad with a heat reflective outer coating layer.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
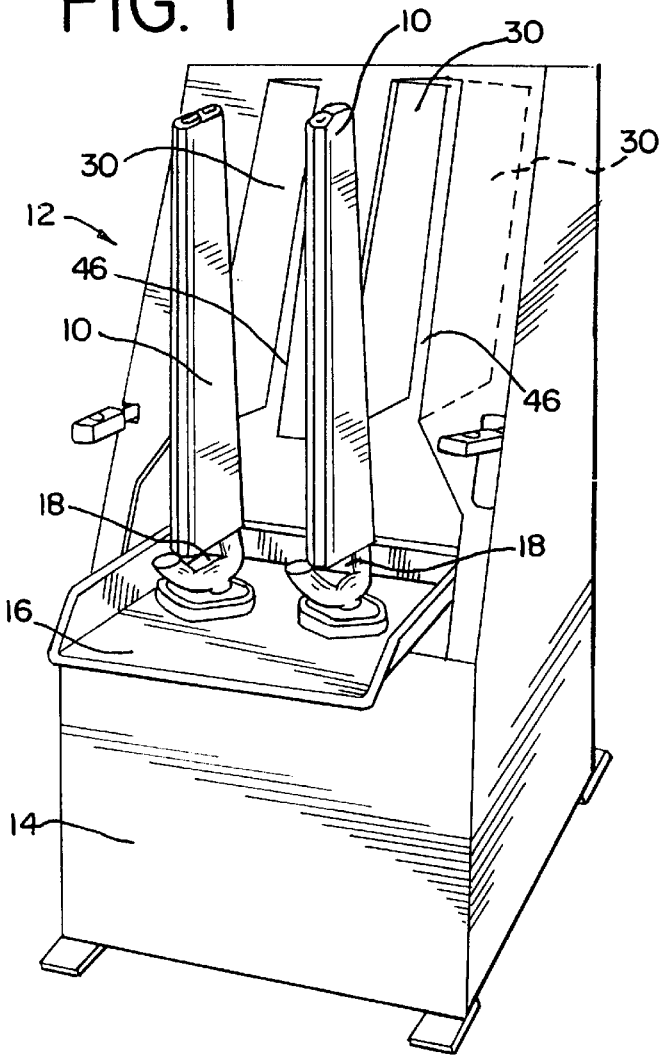
FIG. 1 is a perspective view of a sleeve pressing device, with an example of the present sleever pad shown in position on each of the two bucks.

Referring first to FIG. 1, two examples of the present sleever pad 10 are shown in position in a sleeve pressing device generally designated 12. Briefly, the sleeve of a garment to be pressed (not shown) is placed over each of the sleever pads 10. It should be noted that between the sleever pad 10 and the sleeve of the garment, there is usually positioned a fabric bag 20 (shown in FIG. 2). Once the sleeves to be pressed are in position on the sleever pad 10, each sleeve and sleever pad arrangement is pivoted to move the sleeve within the sleeve pressing device 12, where a pair of heating plates 30 can press each sleeve.

The sleeve pressing device 12 shown in FIG. 1 is commonly used for pressing the sleeves of shirts and other similar garments such as blouses, jackets, and the like. As noted earlier, the sleeve pressing device shown and discussed is only one example of a type of device in which the present sleever pad may be utilized. It is contemplated that the sleever pad of the present invention may also be used in other types of sleeve pressing devices, and that it may also be used in devices for pressing portions of garments other than sleeves, and even for pressing garments other than shirts, blouses, or jackets. The benefits of the present sleever pad may also be valuable in devices for pressing other types of garments such as trousers, skirts, or the like, and even for use in devices for pressing fabric articles other than garments, such as sheets, curtains, etc.

The sleeve pressing device 12 includes a main housing 14 which serves to enclose the primary components of the sleeve pressing device 12. Pivotally attached to the main housing 14 is a tray 16. Attached to the tray 16 are two rigid, elongate, generally plate-like supporting structures 18, commonly called "bucks." The tray 16 is designed to pivot about an axis located within the main housing 14 so that the bucks 18 can be located within the main housing 14.

The bucks 18 are elongated substantially rigid planer structures upon which the sleever pads 10 are placed. Extending upwardly for nearly the entire length of the sleever pads 10, the bucks 18 are somewhat narrower in width than the sleever pads (as best seen in FIG. 2) so that the sleever pads can be easily mounted over the bucks 18.

Figure 2:
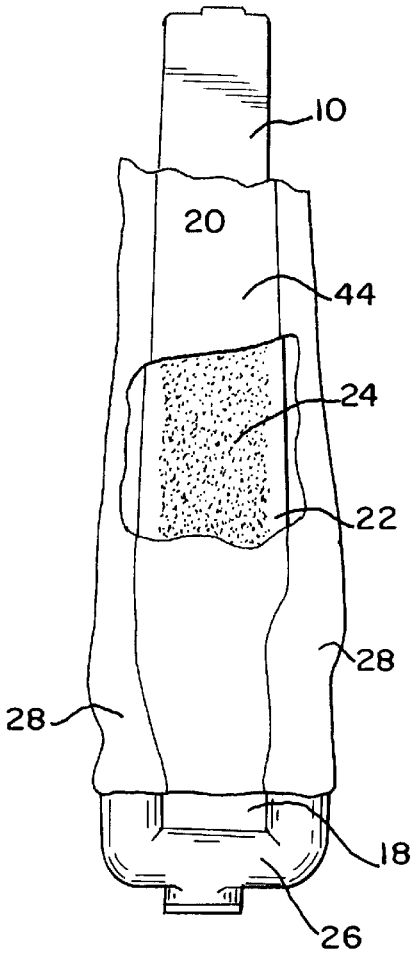
FIG. 2 is a partially cutaway and fragmentary view of the components of the buck assembly, including: the present sleever pad; the fabric bag; and the underlying buck.

FIG. 2 shows a partially cutaway and fragmentary view of several components mounted in position on the buck 18. There are two components mounted on the buck 18—the sleever pad 10 and a fabric bag 20. The sleever pad 10 is placed directly over the buck 18. Then, the fabric bag 20, preferably made of polyester or equivalent material, is placed over the sleever pad 10.

As shown in the cutaway portion of FIG. 2, the buck 18 includes a frame 22, which is generally formed of a rigid, heat conductive material such as steel or the like. In side view, the frame 22 is shaped somewhat like an elongated rectangle that tapers towards its top portion. A body of metallic wire mesh 24 is located upon a central, vertical band portion of the frame 22. A lower portion of the buck 18 includes piping 26, upon which are secured via hose clamps (not shown) corresponding fabric air ducts 28 that are located on either side of the fabric bag 20. The piping 26 supplies air to the air ducts 28 so that the sleeve of the shirt being pressed is pressed in an inflated, non-wrinkled condition.

Figure 3:
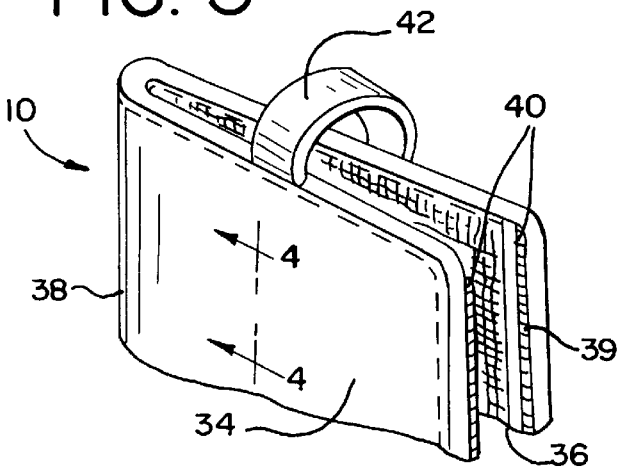
FIG. 3 is an enlarged partial view of the present sleever pad.
Figure 4:
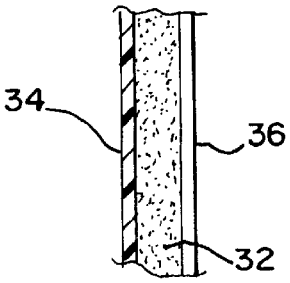
FIG. 4 is a cross sectional view of the present sleever pad, taken along lines 4—4 in FIG. 3, and in the direction generally indicated.

Referring now to FIGS. 3 and 4, the sleever pad 10 is shown as preferably including a relatively stiff internal core 32 of a metallic wire mesh, such as a stainless steel mesh or the like. Optimally, the internal core 32 includes several layers of metallic wire mesh, where the inner layers of the wire mesh are a relatively coarse grade of mesh and the outer layers are a finer grade of mesh.

A covering surrounds the internal core 32 and includes an outer covering layer 34 and an inner liner or covering layer 36. In a preferred embodiment, the outer covering layer 34 is fabricated from a material that is moisture resistant as well as heat reflective. One example of a suitable material for the outer covering layer 34 is either a silicone resin or a polytetrafluoroethylene (PTFE) resin that is impregnated with a fiberglass fabric. The preferred fabric has the PTFE resin, which is commonly sold under the trademark Teflon®, which is owned by E. I. duPont de Nemours & Company of Wilmington, Del. In the preferred embodiment, the moisture resistant properties of the outer covering layer 34 do not substantially diminish for at least one year of regular use in a commercial laundry/dry cleaning operation.

The inner covering layer 36 may be made from any suitable fabric that can withstand the heat of approximately 325° F. generated by the heating plates 30 of the sleeve pressing device 12. The material chosen for the inner covering layer 36 should also be capable of withstanding the moisture and solvents that may be extracted from the garment during the pressing process. One suitable material for the inner covering layer 36 is polyester.

As can be seen in PIG. 3, the sleever pad 10 has a fold 38 which runs vertically down the center or spine of the sleever pad. When the sleever pad 10 is folded along the fold 38, a generally channel-shaped structure is formed. An open end 39 of the channel-shaped structure (which is defined by the outer edges directly opposite the fold 38) includes a zipper 40. During assembly on the buck 18, the zipper 40 may be closed to securely retain the sleever pad 10 on the buck 18, and may be unzipped for removal of the sleever pad. Alternate fastening systems, including snaps and hook and loop fasteners, are contemplated for closing and securing the sleever pad 10 around the buck 18.

In the preferred embodiment, a fabric flap 42 is preferably sewn or otherwise secured to the outer covering layer 34 on both sides of the fold 38. The fabric flap 42 helps to retain the sleever pad 10 upon the buck 18 in at least a partially folded state, even when the zipper 40 is unzipped.

Referring now to FIG. 2, the fabric bag 20 is shown with the top portion cut away to reveal the underlying sleever pad 10. The fabric bag 20, including the two air ducts 28, actually extends upwardly to reach the top of the sleever pad 10. Thus, the fabric bag 20 encases substantially all of the sleever pad 10. As mentioned earlier, the air ducts 28 are connected to the piping 26 through the use of hose clamps (not shown). After the sleeve to be pressed has been positioned on top of the fabric bag 20 (which is covering the sleever pad 10, which is in turn covering the buck 18), air is fed into the air ducts so that the air ducts become inflated.

In this manner, the proper tension is created within the sleeve being pressed whereby the fabric of the sleeve is pulled taut so that no wrinkles are created during the pressing operation.

The fabric bag 20 may be made from any type of material known to be able to withstand both the heat from the heating plates 30 and the harsh chemical and solvent residues that remain on the garment after being laundered, starched, bleached, etc. One example of a suitable material for the fabric bag 20 is polyester. It should be noted that the material for the air ducts 28 should be relatively tightly woven, and possibly even of several plies, so that the air entering into the air ducts does not escape too rapidly, which would not permit the air ducts to properly "balloon" and create the appropriate tension in the sleeve being pressed. The material of the center portion 44 of the fabric bag 20 does not have to be as tightly woven as that used for the air ducts 28 because the center portion 44 does not need to be capable of "ballooning." Accordingly, two different weaves of material may be used for the fabric bag—a tight weave for the air ducts 28 and a more open weave for the center portion 44.

The sleeve pressing operation will now be described. After a shirt or other garment has been laundered, the damp garment is taken to the sleeve pressing device 12. One sleeve (of the pair of sleeves on the garment) is placed on top of each of the two fabric bags 20, which have been each positioned over a sleever pad 10, which have been in turn each positioned and secured (via the zipper 40 or other closing device) over a buck 18. The tapered shape of these three components (the buck 18, the sleever pad 10, and the fabric bag 20, best seen in FIG. 1) helps to better accommodate the shape of the sleeves being placed over them.

A start switch (not shown) on the sleeve pressing device 12 is activated, and air is pumped from the piping 26 and through the air ducts 28 so that they balloon and 20 pull the sleeve fabric taut. Next, the tray 16 is pivoted so that the sleeves (along with the fabric bags 20, the sleever pads 10, and the bucks 18) are introduced into the sleeve pressing device 12 through a pair of slots 46 located on the front of the main housing 14. Once the sleeves are located inside of the sleeve pressing device 12, the two pairs of heating plates 30 (which are either already heated up to a temperature of approximately 325° F. or will begin to heat up), are moved together to press one sleeve between each pair of heating plates. The heating plates remain in contact with the sleeve being pressed for a period of time long enough to both dry and press the damp sleeves. In the preferred embodiment, the heating phase of the pressing cycle lasts approximately sixteen (16) seconds It is during this heating phase of the pressing operation that the benefits of the present sleever pad 10 can be most appreciated. As discussed earlier, the present sleever pad 10 includes an outer covering layer 34 made from a material that is moisture resistant and heat reflective. Thus, any cleaning solvents (such as bleach, detergents, starch, etc.) present on the laundered garment will not migrate into the sleever pad 10, but will instead remain in solution on the garment. In this manner, even after extended use of a year or more in a commercial laundry/dry cleaning operation, solvents will not build up in a concentrated form on the sleever pad 10, where they can separate and then be transferred back to the garment and stain it.

Further, the moisture present on the damp freshly laundered garment will not migrate into the sleever pad 10 either. Thus, the moisture will be in closer proximity to the heating plates 30 so that it can be evaporated more quickly. Therefore, the heating phase of the pressing operation can be completed in less time with the present sleever pad 10 than with one without moisture resistant properties. Accordingly, more garments can be pressed in a shorter amount of time. Moreover, as this moisture resistant property is not substantially diminished over time and with repeated use, the sleever pad 10 does not need to be replaced often in order to continue realizing the benefits obtained from its moisture resistance.

The useful life of the fabric bag 20 located between the sleeve of the garment being pressed and the sleever pad 10 may also be extended due to the present sleever pad. Because the majority of moisture and solvents remain with the garment being pressed, they do not adhere to the fabric bag 20 as readily as they would with the conventional sleever pad. Accordingly, the fabric bag 20 does not become stained with moisture and solvents, which may be transferred back to the garment being pressed. Therefore, the frequent replacement of the fabric bag 20 due to moisture and solvent buildup necessary with the conventional sleever pad is not required with the present sleever pad.

With regard to the heat reflective property of the present sleever pad 10, this feature also aids in reducing the time required to dry the damp garment being pressed. Because heat from the heating plates 30 is reflected back from the sleever pads 10, the heat is not lost within the buck 18, which may act as a heat sink and absorb heat. Accordingly, more heat remains close to the damp garment, which reduces the drying time. Thus, the present sleever pad 10 with the heat reflective outer coating layer 34 provides for a more efficient use the heat from the heating plates 30.

It should be noted that the sleeve pressing operation just described is but one step in the overall pressing process. Different portions of the laundered garment (such as the collar, the cuffs, the main body, etc.) are normally pressed at different pressing stations, either before or after the sleeves are pressed. As mentioned earlier, it is contemplated that the features of the present sleever pad may be adapted for use with those other pressing stations. It is also contemplated that the features of the present sleever pad could also be adopted for use when pressing other types of garments or even other articles that are normally pressed.

While various embodiments of the present improved sleever pad have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

What is claimed is:

1. A sleever pad for use with a sleeve pressing device of the type including a buck upon which said sleever pad is configured to be mounted, a fabric bag adapted to be placed over said sleever pad, and a set of heating plates that are arranged to press a sleeve of a garment placed over the bag, said sleever pad comprising:

a relatively stiff internal core;

a covering surrounding said internal core, said covering including an outer covering layer which faces outwardly toward the sleeve being pressed;

said outer covering layer being made of a moisture resistant material for preventing at least one of moisture and solvents present on the sleeve of the garment being pressed from migrating through said outer covering layer to said internal core, said moisture resistant material also being configured for inhibiting the collection of at least one of moisture and solvents on said sleever pad, and whereby the effectiveness of said outer covering layer is not substantially diminished with repeated use of said sleever pad; and wherein said sleever pad is generally rectangular, and has a generally centrally located vertical fold whereby said sleever pad is folded along said vertical fold to create a generally channel-shaped structure, said sleever pad further including a zipper running along an outer edge opposite said vertical fold, whereby said zipper is configured to facilitate installation, removal, and retention of said sleever pad on the buck.

2. The sleever pad as defined in claim 1 wherein said outer covering layer comprises a polytetrafluoroethylene resin.

3. The sleever pad as defined in claim 1 wherein said outer covering layer comprises a silicone resin.

4. The sleever pad as defined in claim 1 wherein said outer covering layer is comprised of a fiberglass fabric.

5. The sleever pad as defined in claim 1 wherein said covering surrounding said internal core also includes a liner layer which faces inwardly toward the buck.

6. The sleever pad as defined in claim 1 wherein said internal core comprises a wire mesh.

7. The sleever pad as defined in claim 1 wherein said internal core comprises a plurality of layers of wire mesh and includes a coarse layer of wire mesh surrounded by a fine layer of wire mesh.

8. A sleever pad for use with a sleeve pressing device of the type that includes a buck upon which said sleever pad is configured to be mounted, a fabric bag adapted to be placed over said sleever pad, and a set of heating plates that are arranged to press a sleeve of a garment placed over the bag, said sleever pad comprising:

a relatively stiff internal core;

a covering surrounding said internal core, said covering including an outer covering layer which faces outwardly toward the sleeve being pressed and a liner layer which faces inwardly toward the buck; and said outer covering layer being made of a heat reflective material for inhibiting heat from being transferred from the heating plates through said sleever pad to the buck during a pressing operation, said heat reflective material of said outer covering layer also being moisture resistant for preventing at least one of moisture and solvents present on the sleeve of the garment being pressed from migrating through said outer covering layer to said internal core.

9. The sleever pad as defined in claim 8 wherein said outer covering layer comprises a polytetrafluoroethylene resin.

10. The sleever pad as defined in claim 8 wherein said outer covering layer comprises a silicone resin.

11. The sleever pad as defined in claim 8 wherein said sleever pad is generally rectangular, and has a generally centrally located vertical fold whereby said sleever pad is folded along said vertical fold to create a generally channel-shaped structure; and further wherein said sleever pad includes a closing means running along an outer edge opposite said vertical fold, whereby said closing means is configured to facilitate installation, removal, and retention of said sleever pad on the buck.

12. The sleever pad as defined in claim 8, wherein said outer covering layer is configured for inhibiting the collection of at least one of moisture and solvents on said sleever pad, and whereby the effectiveness of said outer covering layer is not substantially diminished with repeated use of said sleever pad.

13. The sleever pad as defined in claim 8, wherein said sleever pad is generally rectangular, and has a generally centrally located vertical fold whereby said sleever pad is folded along said vertical fold to create a generally channel-shaped structure, said sleever pad further including a zipper configured to facilitate installation, removal, and retention of said sleever pad on the buck.

14. The sleever pad as defined in claim 8, wherein said sleever pad is generally rectangular, and has a generally centrally located vertical fold whereby said sleever pad is folded along said vertical fold to create a generally channel-shaped structure, said sleever pad further including a closing means positioned along an outer edge opposite said vertical fold, whereby said closing means is configured to facilitate installation, removal, and retention of said sleever pad on the buck.

15. A sleever pad for use with a sleeve pressing device of the type that includes a buck upon which said sleever pad is configured to be mounted, a fabric bag adapted to be placed over said sleever pad, and a set of heating plates that are arranged to press a sleeve of a garment placed over the bag, said sleever pad comprising:

a relatively stiff internal core;

a covering surrounding said internal core, said covering including an outer covering layer which faces outwardly toward the sleeve being pressed and a liner layer which faces inwardly toward the buck; and said outer covering layer being configured for preventing at least one of moisture and solvents present on the sleeve of the garment being pressed from migrating through said outer covering layer to said internal core, and said outer covering layer also being configured for inhibiting heat from being transferred from the heating plates through said sleever pad to the buck during a pressing operation.

16. The sleever pad as defined in claim 15 wherein said outer covering layer comprises a polytetrafluoroethylene resin.

17. The sleever pad as defined in claim 15 wherein said outer covering layer comprises a silicone resin.

18. The sleever pad as defined in claim 15, wherein said outer covering layer is configured for inhibiting the collection of at least one of moisture and solvents on said sleever pad, and whereby the effectiveness of said outer covering layer is not substantially diminished with repeated use of said sleever pad.

19. The sleever pad as defined in claim 15, wherein said sleever pad is generally rectangular, and has a generally centrally located vertical fold whereby said sleever pad is folded along said vertical fold to create a generally channel-shaped structure, said sleever pad further including a closing means positioned along an outer edge opposite said vertical fold, whereby said closing means is configured to facilitate installation, removal, and retention of said sleever pad on the buck.

20. The sleever pad as defined in claim 19 wherein said closing means comprises a zipper.

* * * * *